United States Patent [19]

Stora et al.

[11] 4,332,236

[45] Jun. 1, 1982

[54] FIREPLACE HEAT EXCHANGER

[76] Inventors: Richard A. Stora, 434 Hill Lake Ave., Wayland, Mich. 49348; Edward J. Chase, Jr., 1400 11 Mile Rd., NE., Comstock Part, Mich. 49321

[21] Appl. No.: 124,520

[22] Filed: Feb. 25, 1980

[51] Int. Cl.[3] ..... F24B 7/00; F24F 3/14

[52] U.S. Cl. ..... 126/121; 126/134; 126/152 B; 126/164; 237/78 R; 165/173

[58] Field of Search ..... 126/134, 121, 113, 313, 126/132, 131, 123, 152 A, 152 B, 164, 163 R; 165/173, DIG. 14; 237/51, 78 R; 261/1, 136

[56] References Cited

U.S. PATENT DOCUMENTS

| | | | |
|---|---|---|---|
| 3,955,553 | 5/1976 | Soeffker | 126/121 |
| 4,252,106 | 2/1981 | Estes | 126/134 X |
| 4,297,986 | 11/1981 | Lehrer | 126/121 |

*Primary Examiner*—Samuel Scott
*Assistant Examiner*—Randall L. Green
*Attorney, Agent, or Firm*—Price, Heneveld, Huizenga & Cooper

[57] ABSTRACT

A fireplace heat exchanger comprises a plurality of laterally spaced, C-shaped heat transfer tubes, each having a mounting plate connected at its lower end. A header extends along the tube lower ends to flow air therethrough, and removable fasteners individually connect each mounting plate to the header. A bracket interconnects the outer ends of the tubes, such that a damaged tube can be easily replaced by disassembling the bracket, removing the fasteners from the damaged tube, and detaching the mounting plate. The heat exchanger also includes a humidifier, comprising a water carrying conduit which extends through one of the tubes. Water droplets are slowly metered from the conduit onto a hot upper surface of the tube, and vaporize substantially instantaneously upon impingement to therewith mix with and humidify the heated air flowing through the tube.

19 Claims, 8 Drawing Figures

FIREPLACE HEAT EXCHANGER

BACKGROUND OF THE INVENTION

The present invention relates to heaters, and in particular to heat exchangers for fireplaces.

Fireplace heat exchangers are well known and widely used to improve the heating efficiency of conventional fireplace structures, such as those typically built in private, residential homes. Some of these devices comprise a plurality of heat transfer tubes which are interconnected in a side-by-side manner, and are generally C-shaped, with a base or grate portion adapted to retain burning wood or other fuels thereon, and an upper portion located in the firebox directly above the combustion area. The air in the room is circulated through the tubes by means of a blower or thermal siphoning. The tubes are heated by the fire, and transfer the absorbed heat to the air circulating through the tubes.

The heat transfer tubes commonly deteriorate rather quickly, because they are directly subjected to very high temperatures for extended periods of time. Since the tubes of many heat exchanger devices are welded together as a unit, when one of the tubes breaks through, the entire unit must be discarded and replaced. Although the heat transfer tubes of some fireplace heat exchangers can be individually replaced, they require a quite difficult and time consuming repair, because the various parts oxidize quickly and rust solidly together. Some of these devices provide a comparatively weak structure which is not capable of securely supporting the burning fuels thereon during extended use.

Further, heretofore fireplace heat exchangers did not usually include any means for humidifying the air which it heated, thereby detracting form the comfort of the room environment and requiring additional heat to achieve the same comfort level. Several attempts have been made to provide humidifiers for such units, however, none have proven both efficient and inexpensive.

SUMMARY OF THE INVENTION

One aspect of the present invention comprises a fireplace heat exchanger including a plurality of laterally spaced apart heat transfer tubes, each having a body shaped for placement in a firebox. The tubes include a lower end shaped to draw cool room air into the tubes, a medial portion adapted for positioning adjacent a source of heat and transferring heat to the cool air, and an upper end shaped to expel the heated air into the room. A header extends along the lower end of each of the tubes, and communicates therewith to flow air into the heat exchanger. The tubes each have a mounting plate fastened to the lower end thereof, and removable fasteners individually connect each mounting plate and tube assembly to the header. At least one bracket detachably interconnects each of the tubes at a position spaced apart from the header, whereby a damaged heat transfer tube may be easily removed from the heat exchanger and replaced by disassembling the bracket, loosening the fasteners associated with the damaged tube, and detaching the associated mounting plate and tube assembly from the header.

Another aspect of the present invention comprises a humidifier for fireplace heat exchangers which includes a water carrying conduit disposed in and extending through a portion of one of the heat exchanger tubes. The water conduit has a lower end communicating with a regulated source of water, and an upper end having a discharge opening which is positioned above the heated surface of the upper portion of the tube. The discharge opening is sized to slowly meter water therethrough at a rate which causes droplets emitted therefrom to vaporize substantially instantaneously upon impingement with the heated tube surface, whereby the water vapor so formed mixes with the heated room air flowing through the tube to expel heated and humidified air into the room.

The principal objects of the present invention are: to provide a fireplace heat exchanger having means for securely, yet detachably interconnecting the heat transfer tubes, such that a damaged tube can be easily removed and replaced; to provide such a heat exchanger which includes a humidifier capable of efficiently introducing water vapor into the heated air; to provide such a heat exchanger wherein water vapor is introduced into the air by metering water droplets onto a hot surface of a heat transfer tube; to provide such a heat exchanger wherein the humidifier water is flowed through a conduit extending through a heat exchanger tube so as to preheat the water for improved efficiency; and to provide such a heat exchanger which is economical to manufacture, efficient in use, capable of a long operating life, and particularly well adapted for the proposed use.

These and many other important advantages of the present invention will be further understood and appreciated by those skilled in the art by reference to the following written specification, claims, and appended drawings.

DETAILED DESCRIPTION OF THE PREFERRED EMBODIMENTS

Figure 1:
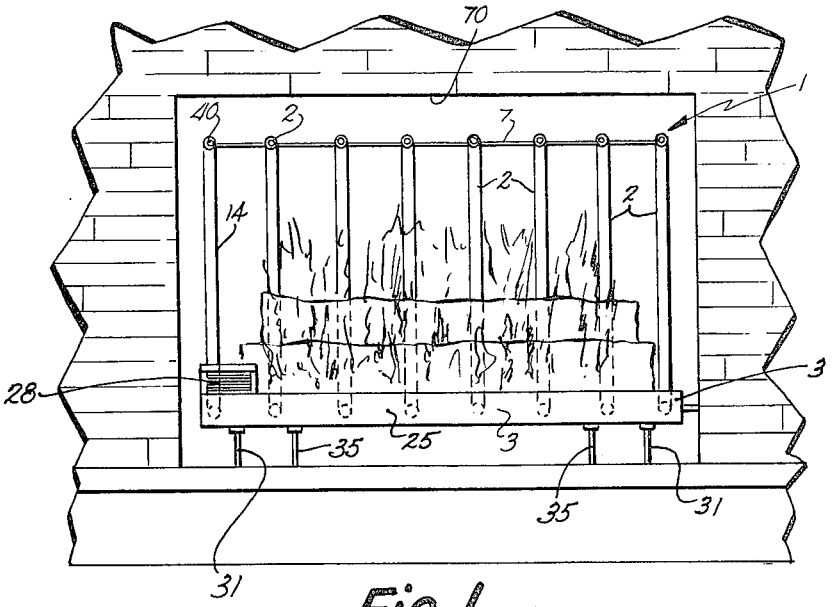
FIG. 1 is a front elevational view of a fireplace heat exchanger embodying the present invention, shown installed in a fireplace.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations, except where expressly specified to the contrary.

The reference numeral 1 (FIGS. 1 and 2) generally designates a fireplace heat exchanger or heater embodying the present invention, and comprises a plurality of laterally spaced apart heat transfer tubes 2 adapted for circulating air therethrough. A header 3 extends along the lower end of each of the tubes 2 and supplies incoming air thereto. The tubes 2 each have a mounting plate 4 connected with the lower end thereof, and removable fasteners 5 individually connect each mounting plate and tube assembly to header 3. Brackets 6 and 7 detachably interconnect each of the tubes 2 at positions spaced apart from header 3, such that a damaged heat transfer tube 2 may be easily removed from the heat exchanger 1 and replaced by disassembling brackets 6 and 7, loosening those fasteners 5 associated with the damaged tube, and detaching the associated mounting plate 4 and damaged tube 2 from header 3.

The heat exchanger tubes 2 (FIG. 2) are substantially C-shaped, and include straight, mutually parallel base and upper portions 12 and 13 respectively, and a forwardly inclined rear portion 12. Tubes 2 are preferably integrally formed by means such as a tube bender. The base portions 12 are adapted to receive and retain burning fuel, such as logs, or the like, thereon and collectively act as a grate. The upper portions 13 of tubes 2 are disposed substantially directly above the combustion area of fire, and are exposed to heat radiating therefrom, as well as to hot exhaust gases which pass over the tubes and then raise up the flue. Tubes 2 preferably have a circular transverse cross-sectional shape, and are constructed of a relatively thick steel pipe material, in the nature of 1 inch O.D., and 1/16 inch wall thickness.

Figure 3:
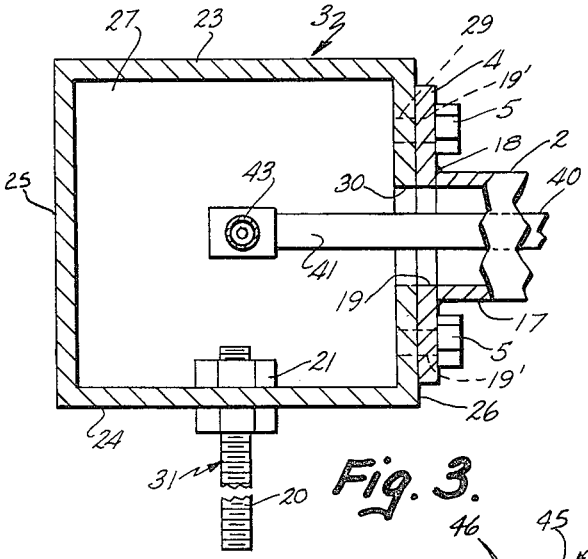
FIG. 3 is an enlarged, fragmentary vertical cross-sectional view of the heat exchanger, taken along the line III—III, FIG. 6, particularly showing a header with a tube mounting plate.
Figure 4:
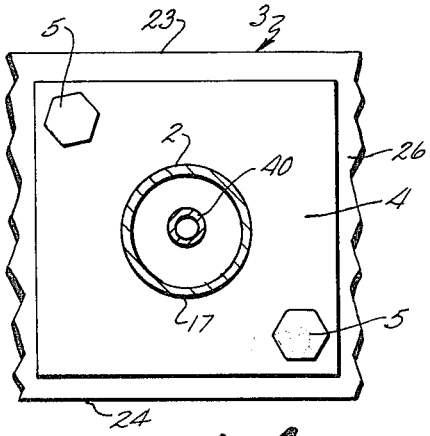
FIG. 4 is an enlarged, fragmentary rear plan view of the header with the tube broken away.

As best illustrated in FIGS. 3 and 4, mounting plates 4 are fixedly attached to the lower end 17 of tubes 2 by means such as welds 18. Each of the illustrated mounting plates 4 has a substantially square shape with a circular aperture 19 through the center shaped substantially identical to and aligned with the inside surface of the tube. Two additional apertures 19' are located in opposing corners of mounting plate 4 and receive fasteners 5 therethrough.

Figure 6:
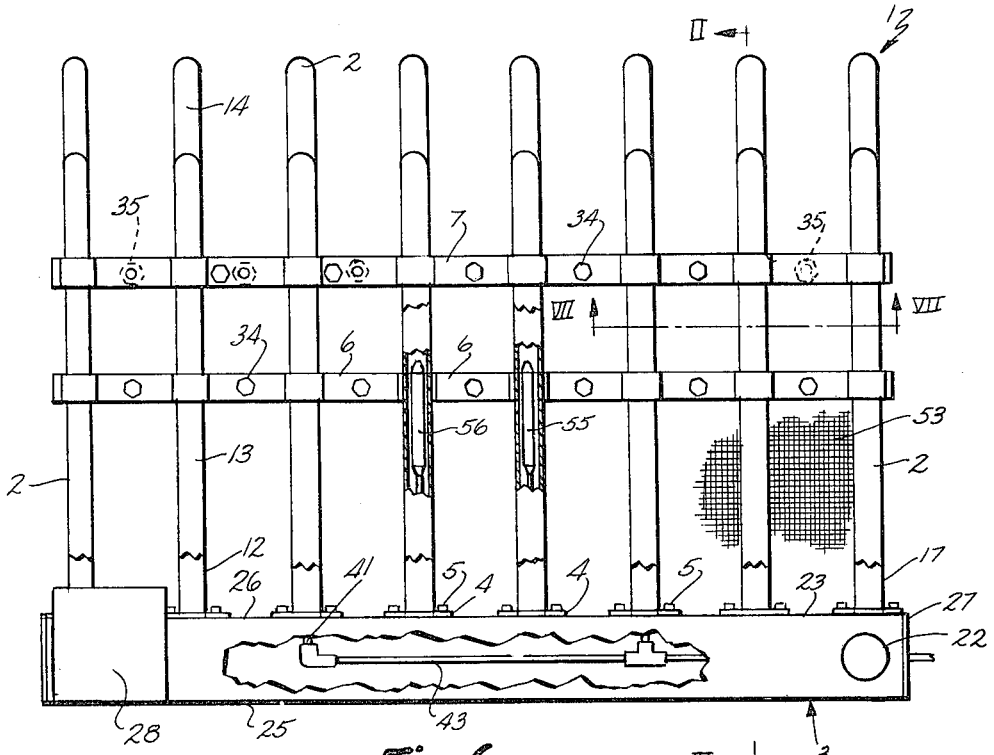
FIG. 6 is a top plan view of the heat exchanger, with portions thereof broken away to reveal internal construction.

Header 3 (FIGS. 3, 4 and 6) extends laterally along the lower ends 17 of heat exchanger tubes 2, and supplies room air to the same. The illustrated header 4 has a substantially square transverse cross-sectional shape, with upper, lower, forward, and rear faces 23–26 respectively. End plates 27 form closures for the ends of header 3, and in this example a blower 28 is mounted on the upper face 23 of header 3 and draws air in from the room and blows it into header 3 for distribution to each of the tubes 2. If the heater is to be operated without a blower (e.g. by thermal siphoning), header 2 is provided with an opening (not shown), preferably in the forward face 25 to allow cool air to be drawn into the heater. The rear face 26 of header 3 is flat and adapted for sealing abutment with each of the mounting plates 4, and in this example, includes threaded apertures 29 which mate with the fasteners 5. The header rear face 26 also includes a plurality of ports 30 which are spaced apart along the length of header 3, in alignment with mounting plate apertures 19, so as to flow the air in the header into tubes 2. Header 3 also includes a pair of legs 31 (FIG. 3) which support the forward portion of the header. Legs 31 comprise threaded studs 20 which extend through apertures in the lower face 24 of the header at points adjacent the ends thereof, and a pair of nuts 21 on each side of the header face, such that the leg is vertically adjustable. As shown in FIGS. 6, the upper face 23 of header 2 may be provided with a knock-out plug 22 to facilitate mounting blower 28 on the opposite end of the header.

Figure 7:
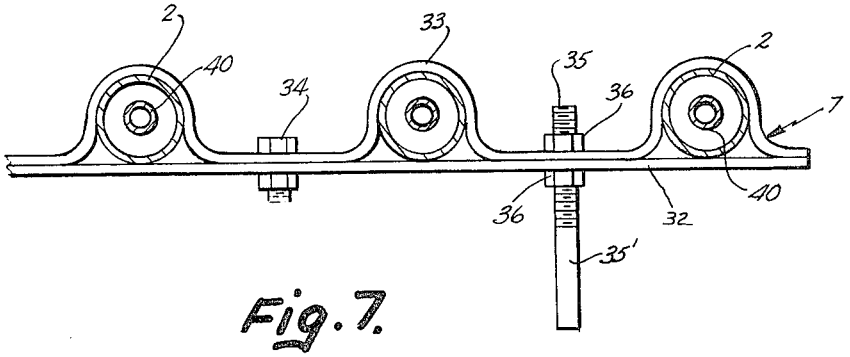
FIG. 7 is an enlarged vertical cross-sectional view of a bracket portion of the heat exchanger, taken along the line VII—VII, FIG. 6.

Brackets 6 and 7 are connected with the upper and lower portions 13 and 12 respectively of tubes 2 and extend laterally thereacross to securely interconnect the same in a predetermined formation. As best illustrated in FIG. 7, each of the brackets 6 and 7 includes a saddle clamp arrangement having a lower, flat plate 32 and an upper, corrugated strap 33 with circularly shaped recesses in which the heat transfer tubes 2 are received. The plate 32 and strap 33 are securely clamped together by fasteners 34 and frictionally retain tubes 2 therebetween. The lower bracket 7 is provided with a pair of adjustable feet 35 which mate with the forward feet 31, and comprise a threaded stud 35' having a pair of nuts 36 disposed on either side of the bracket.

A water carrying conduit 40 (FIG. 2) is disposed in and extends through at least one of heat exchanger tubes 2, and has a lower end 41 adapted for communication with a regulated source of water, and an upper end 42 positioned in the upper portion 13 of tube 2 at a location spaced somewhat inwardly from the upper free end of the tube. In this example, two of the heat exchanger tubes 2 (FIG. 6) are provided with a humidifying conduit 40, with the two tubes located approximately one-third the distance from each end of the heater so as to be disposed generally at the hottest portions of the fire. The lower end 41 of both conduits 40 extends through an associated one of the ports 30 into the center of header 3, and a water manifold 43 interconnects both conduits 40, and extends outwardly through the right-hand end plate 27 connection with a regulated source of water.

Figure 5:
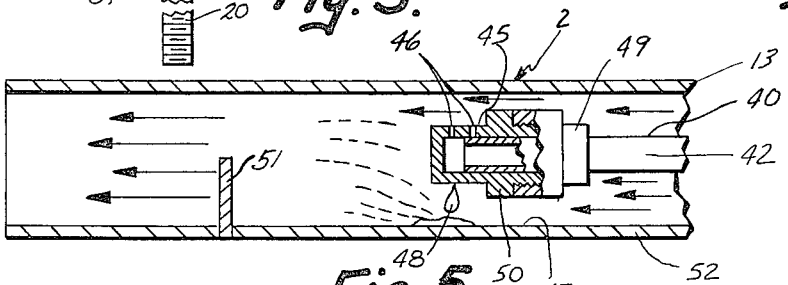
FIG. 5 is an enlarged, fragmentary vertical cross-sectional view of the upper end of one of the tubes, particularly showing a humidifying device therein.

As best illustrated in FIG. 5, the upper end 42 of each conduit 40 includes a fitting 45 with a discharge opening or orifice 46 positioned above a heated surface 47 of the tube upper portion 13. The discharge opening 46 is sized to slowly meter water therethrough at a rate causing droplets 48 emitted therefrom to vaporize substantially instantaneously upon impingement with the heated tube surface 47, such that the water vapor so formed mixes with the heated room air flowing through the tube (as illustrated by the arrows) to expel heated and humidified air into the room. The discharge opening 46 may comprise a single aperture through fitting 45, with a diameter in the nature of 1/8 of an inch, and oriented vertically in the uppermost portion of the fitting side wall. The illustrated fitting 45 includes a rear half 49 fixedly connected with conduit 40 by means such as a solder joint or a ferrule fitting, and a forward half 50 threadedly connected with rear half 49. Forward half 50 has a barrel-shaped body with a closed end, and two longitudinally spaced discharge orifices 46. Rotation of the forward body half 50 with respect to stationary rear half 49 causes the forward half to move inwardly and outwardly in a telescoping manner over conduit 40, thereby closing and opening the discharge orifices 46 to control the flow of water therethrough. The orifices 46 are preferably oriented in a vertically upward direction (as shown in FIG. 5), such that the water discharged therefrom flows around the outer surface of the forward body 50 and forms droplets 48 on the underneath side thereof. It is believed that this design facilitates efficient vaporization. The fitting 45 is preferably located a distance in the nature of 10–12 inches inwardly from the free end of the tube, so that surface 47 remains very hot during the operation of the humidifier. Semicircularly shaped baffles 51 are mounted in the lower half of the upper portion of those tubes having humidifying conduits 40 therein. Baffles 51 are positioned on either side of the fitting 45, and positively prevent unvaporized water droplets from draining from the upper portion of the tube.

Both the water manifold 43 and conduits 40 are preferably constructed of a material which is highly conductive, such as copper tubing, so that as the water flows through header 3 and the associated heat transfer tube 2, it is preheated so as to insure substantially instantaneous vaporization when discharged from orifice 46. In this example, the upper end of the tubes carrying humidifying conduits 40 have a two-part construction, which includes a separate outer section 52 in which the vaporizing surface 47 is disposed, which is constructed of a material highly resistant to corrosion, such as stainless steel, and is fixedly attached to the rearward portion by means such as welding or the like. The vaporizing surface 47 is oriented substantially horizontally to insure that the droplets impinging upon the vaporizing surface do not tend to run rearwardly back down the tube. two sheets of wire mesh or screen 53 (FIGS. 2 and 6) are connected with the upper and lower surfaces of the tube base portions 12. The upper screen 53 tends to retain the larger embers thereon, and the lower screen 53 traps the smaller embers between the screens so as to transfer additional heat energy to the tubes 2. Screens having a ¼ inch mesh have proven satisfactory for this purpose.

Figure 2:
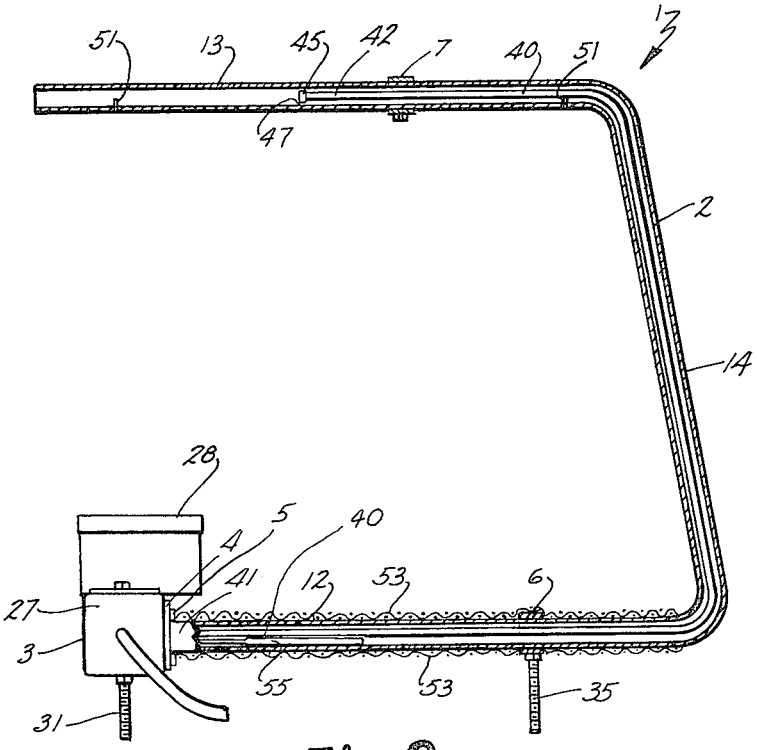
FIG. 2 is a side elevational view of the heat exchanger with a heat exchanger tube portion thereof broken away to reveal internal construction.
Figure 8:
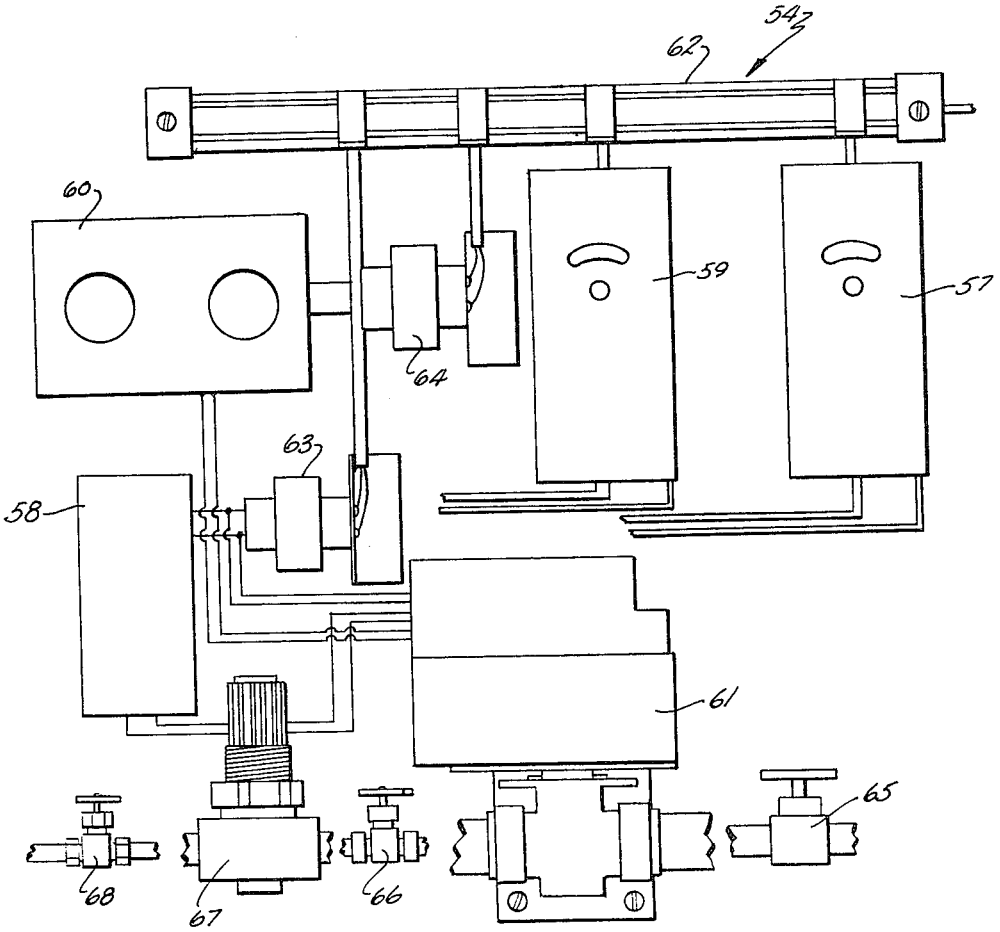
FIG. 8 is a schematic illustration of a control system for the heat exchanger.

A control system 54 (FIG. 8) is provided to insure that water is discharged from orifice 46 only when the vaporizing surface 47 is sufficiently hot to substantially instantaneously vaporize droplets impinging thereupon, as well as to regulate the humidity once the humidifier is in operation. The control system also regulates the blower 28 in response to temperature changes in the room. Control system 54 includes two separate temperature sensors 55 and 56 (FIG. 6) which are positioned in the base portion of the pair of heat exchange tubes located centrally adjacent the hottest area of the fire. Temperature sensors 55 and 56 are of a conventional construction, and are supported on the lower interior surface of the tubes, as best shown in FIG. 2. Sensor 55 is connected with a blower controller 57 (FIG. 8) which is in turn connected with blower 28 through a thermostat 58. Controller 57 makes and brakes the electrical circuit to blower 28, and insures that the blower will not come on unless sensor 55 indicates that the fire has reached a minimum temperature, in the nature of 90° F. If the fire is left unattended, or otherwise burns down to a level which produces a temperature in the sensor below this level, the blower will be automatically turned off.

The other temperature sensor 56 is connected with a humidifier controller 59, which is in turn connected with a humidistat 60. Humidifier controller 59 insures that water will not be emitted from any discharge orifice 46 unless the temperature of sensor 56 reaches a predetermined temperature, preferably in the range of 200°–260° F. If the temperature registered by sensor 56 goes below this level, a water control valve 61 is closed, thereby halting water flow in conduits 40. This arrangement insures that if the fire is not hot enough to cause vaporizing surface 47 to vaporize droplets 48 substantially instantaneously, the humidifier will be shut off.

Controllers 57 and 59 are powered directly by a 110 VAC power source 62, and transformers 63 and 64 power thermostat 58 and humidistat 50 respectively. The illustrated water supply system includes in sequence, a main shut-off valve 65, solenoid operated control valve 61, a secondary shut-off valve 66, a pressure regulator 67, and a needle valve 68. Pressure regulator 67 permits the user to accurately adjust water flow to a desired trickle, and then lock the valve setting place.

In use, the heater 1 is inserted into a fireplace opening 70 (FIG. 1) with header 3 disposed substantially flush with the face of the fireplace, and the upper free ends of the tubes 2 projecting slightly outwardly into the room. The feet 31 and 35 are adjusted in a manner such that the base portions 12 of tubes 2 are spaced upwardly from the bottom of the firebox, and the tube upper ends 13 are level. The thermostat 58 and humidistat 60 are mounted on suitable wall surfaces in the room, and the water manifold 43 is connected with a suitable source of water, such as a residential plumbing line. If the heater 1 is provided with a blower 28, the same is wired to a source of electrical power. Fuel is then placed on top of the base portion 12 of the tubes 2 and is ignited to create a source of heat. The sensors 56 and 57 detect the temperature increase as the fire burns, and when sensor 56 reaches the temperature set in controller 57 (approximately 90°), the blower circuit is opened to the thermostat 58. If the temperature of the room is lower than the desired room temperature set on the thermostat, the thermostat circuit is also open, such that blower 28 is energized and room air is flowed through heater tubes 2. As the fire heats up above the temperature set on controller 59 (approximately 220°–260° F.) the humidistat circuit is opened to humidistat 60, such that if the humidity in the room is below that level set in the humidistat, control valve 61 is opened and water is metered through discharge orifices 46 at a rate which causes the droplets to vaporize substantially immediately when they drop onto tube surface 47. If additional humidity is desired, the user can unscrew forward fitting half 50 to open the second discharge orifice 46. The low temperature setting on controller 56 is adjusted to a level slightly above that temperature at which the droplets will no longer immediately vaporize. If the temperature of the fire (as registered by sensor 56) drops below the selected range (220° F.), valve 61 is closed and the humidifier is thereby shut off. The blower will continue to cycle on and off as directed by thermostat 58, until the temperature of sensor 55 falls below the set level (90° F.), at which time both the blower and the humidistat are deactivated.

Should one or more of the tubes 2 require replacement, the user simply disassembles both bracket 6 and 7 by loosening fasteners 43, and detaches the rear feet 35. The damaged tube is then removed by loosening the associated fasteners 5, and pulling the mounting plate 4 from header 3. A new tube is installed by simply reversing the above recited steps.

In the foregoing description, it will be readily appreciated by those skilled in the art that many modifications may be made to the invention without departing from the concepts disclosed herein. Such modifications are to be considered as included in the following claims unless these claims by their language expressly state otherwise.

The embodiments of the invention in which an exclusive property or privilege is claimed are defined as follows:

1. A fireplace heat exhanger, comprising:

a plurality of laterally spaced apart heat transfer tubes, each having a body shaped for placement in a firebox, and including a lower end thereof shaped to draw cool room air into the tubes, a medial portion adapted for positioning adjacent a source of heat and transferring heat to the cool air, and an upper end shaped to expel the heated air into the room;

a plurality of mounting plates, each being connected with a different one of said tubes at the lower end thereof;

a header extending along the lower end of each of said tubes and communicating therewith for flowing air into the heat exchanger;

removable fastener means for individually connecting each of said mounting plates to said header; and at least one bracket detachably interconnecting each of said tubes, and being disposed at a position spaced apart from said header, whereby a damaged heat transfer tube can be easily removed from said heat exchanger and replaced by disassembling said bracket, loosening the fastener means associated with the damaged tube, and detaching the associated mounting plate from said header.

2. A fireplace heat exchanger as set forth in claim 1, wherein:

said bracket is positioned along said tube medial portion at a rearward, base portion thereof.

3. A fireplace heat exchanger as set forth in claim 2, including:

a second bracket positioned adjacent said tube upper end.

4. A fireplace heat exchanger as set forth in claim 1, wherein:

said mounting plates are connected with a rear face of said header.

5. A fireplace heat exchanger as set forth in claim 4, wherein said header comprises a tube having a substantially rectangular transverse cross-sectional shape.

6. A fireplace heat exchanger as set forth in claim 1, wherein:

said upper end of at least one of said heat transfer tubes is shaped for positioning above the burning fuel and is heated thereby; and including a water carrying conduit disposed in and extending through a portion of said one heat exchanger tube; said water conduit having a lower end thereof adapted for communicating with a regulated source of water, and an upper end thereof including a discharge opening positioned above a heated surface of the upper end of said one tube; said discharge opening being sized to slowly meter water therethrough at a rate causing droplets emitted from said discharge opening to vaporize substantially instantaneously upon impingement with said heated tube surface, whereby the water vapor so formed mixes with the heated room air flowing through said one tube to expel heated and humidified air into the room.

7. A fireplace heat exchanger as set forth in claim 6, wherein:

at least two of said heat transfer tubes include a water carrying conduit therein; and including a water manifold communicating the lower end of each conduit with said source of water.

8. A fireplace heat exchanger as set forth in claim 7, wherein:

said water manifold is positioned in said header.

9. A fireplace heat exchanger as set forth in claim 8, wherein:

each water conduit is constructed of a heat conductive material, whereby the water flowing therethrough is preheated for efficient vaporization.

10. In a fireplace heat exchanger having a plurality of heat exchanger tubes through which room air is flowed and heated, and wherein the tubes are shaped for placement in a firebox, with upper portions of the tubes adapted for positioning above the burning fuel and being heated thereby, the improvement of a humidifier, comprising:

a water carrying conduit disposed in and extending through a portion of at least one of said heat exchanger tubes; said water conduit having a lower end thereof adapted for communicating with a regulated source of water, and an upper end thereof including a discharge opening positioned above a heated surface of the upper portion of said one tube; said discharge opening being sized to slowly meter water therethrough at a rate causing droplets emitted from said discharge opening to vaporize substantially instantaneously upon impingement with said heated tube surface, whereby the water vapor so formed mixes with the heated room air flowing through said one tube to expel heated and humidified air into the room.

11. A fireplace heat exchanger as set forth in claim 10, wherein:

said tube heated surface is oriented substantially horizontally.

12. A fireplace heat exchanger as set forth in claim 11, wherein:

said one heat exchanging tube has an upper free end through which heated room air is expelled; and said discharge opening is positioned inwardly from the upper free end of said one heat exchanger tube.

13. A fireplace heat exchanger as set forth in claim 10, wherein:

said water conduit is constructed of a heat conductive material, whereby the water flowing therethrough is preheated in said one heat exchanger tube.

14. A fireplace heat exchanger as set forth in claim 13, wherein:

said tube heated surface is oriented substantially horizontally.

15. A fireplace heat exchanger as set forth in claim 14, wherein:

said one heat exchanging tube has an upper free end through which heated room air is expelled; and said discharge opening is positioned inwardly from the upper free end of said one heat exchanger tube.

16. A fireplace heat exchanger as set forth in claim 10, wherein:

said one tube has a two-part construction, wherein that tube portion having said heated vaporizing surface therein is constructed of a highly corrosion resistant material.

17. A fireplace heat exchanger as set forth in claim 10, including:

a control circuit which halts water flow through said conduit when the temperature of the vaporizing surface falls below that temperature which is required to have the droplets vaporize substantially immediately upon impingement therewith.

18. A fireplace heat exchanger as set forth in claim 10, wherein:

said conduit includes an end fitting having the discharge opening therein disposed in a vertically upward orientation.

19. A fireplace heat exchanger as set forth in claim 10, wherein:

said conduit includes an end fitting having the discharge opening therein, and means for opening and closing a second discharge opening.

* * * * *

UNITED STATES PATENT AND TRADEMARK OFFICE

CERTIFICATE OF CORRECTION

PATENT NO. : 4,332,236

DATED : June 1, 1982

INVENTOR(S) : Richard A. Stora et al

It is certified that error appears in the above—identified patent and that said Letters Patent is hereby corrected as shown below:

Column 1, line 36:
"form" should be --from--

Column 3, line 52:
"2" should be --3--

Column 3, line 68:
"Figs." should be --Fig.--

Column 4, line 1:
"2" should be --3--

Column 5, line 61:
"200-260° F." should be --220-260° F.--

Signed and Sealed this

*Twelfth* Day of *October 1982*

[SEAL]

*Attest:*

GERALD J. MOSSINGHOFF

*Attesting Officer*

*Commissioner of Patents and Trademarks*